US006332408B2

(12) United States Patent
Howlett et al.

(10) Patent No.: US 6,332,408 B2
(45) Date of Patent: Dec. 25, 2001

(54) PRESSURE FEEDBACK SIGNAL TO OPTIMISE COMBUSTION AIR CONTROL

(76) Inventors: Michael Howlett, 755 Boissy Street, St. Lambert, QC (CA), J4R 1K1; Gordon Alexander Murray, 13 Apple Hill Road, Baie D'Urfé , QC (CA), H9X 3G7; William E. Crowle, 303 St-Julien, Rigaud, QC (CA), J0P 1P0

( * ) Notice: Subject to any disclaimer, the term of this patent is extended or adjusted under 35 U.S.C. 154(b) by 0 days.

(21) Appl. No.: 09/761,424

(22) Filed: Jan. 16, 2001

Related U.S. Application Data

(60) Provisional application No. 60/175,927, filed on Jan. 13, 2000.

(51) Int. Cl.[7] ..... F23N 5/18

(52) U.S. Cl. ..... 110/189; 110/185; 110/186; 431/12; 431/75; 431/90

(58) Field of Search ..... 110/185, 186, 110/187, 188, 189, 190; 431/12, 90, 18; 236/15 BD

(56) References Cited

U.S. PATENT DOCUMENTS 4,421,473 * 12/1983 Londerville ..... 431/76
4,645,450 * 2/1987 West ..... 431/12
4,683,841 * 8/1987 Andersson et al. ..... 122/22
4,699,586 * 10/1987 Snyder ..... 431/6
4,861,262 * 8/1989 Gitman et al. ..... 431/5
5,037,291 * 8/1991 Clark ..... 431/12
5,660,542 * 8/1997 Rinker et al. ..... 432/19
5,685,707 * 11/1997 Ramsdell et al. ..... 431/90
5,730,069 * 3/1998 Coolidge et al. ..... 110/187
5,785,512 * 7/1998 Cormier ..... 431/749
5,887,583 * 3/1999 Irwin et al. ..... 126/343.5 A
5,971,745 * 10/1999 Bassett et al. ..... 431/12
6,019,593 * 2/2000 Lewandowski et al. ..... 431/12
6,077,068 * 6/2000 Okumura ..... 431/1
6,095,793 * 8/2000 Greeb ..... 431/12
6,206,687 * 3/2001 Redington ..... 431/90

* cited by examiner

*Primary Examiner*—Denise L. Esquivel
*Assistant Examiner*—K. B. Rinehart

(57) ABSTRACT

A novel method of combustion air control for multiple burner furnaces, whereas a pressure transducer is located in the air piping downstream of each zone air flow control device. The pressure transducer sends a feedback signal to a pressure control loop that is in a logical cascade from the furnace temperature control loop. The pressure control loop repositions the air flow control device to compensate for changes in both downstream and upstream conditions. Output from the temperature control loop is interpreted by the pressure control loop as a changing remote set-point value. In one embodiment, the system is ideally suited to compensate for the pressure drop changes that occur across a zone air flow control valve, when flow rate changes occur as burners are started or stopped, thus providing a substantially higher turndown ratio and better control at low fire settings.

4 Claims, 3 Drawing Sheets

PRESSURE FEEDBACK SIGNAL TO OPTIMISE COMBUSTION AIR CONTROL

BACKGROUND—Cross-References to Related Applications

This application claims the benefit of Provisional Patent Application Ser. No. 60/175,927 filed on Jan. 13, 2000.

BACKGROUND—Field of Invention

This invention relates to combustion systems primarily where there is more than one burner in a controlled zone or section.

BACKGROUND—Discussion of Prior Art

At the present time, there are four basic types of combustion control systems used in multiple burner furnaces. They are; pressure balance control, linked valve control, flow balance control and mass flow control.

In the first three cases, a single flow control valve is normally used to control the combustion air flow to a group (zone) of burners. This valve is usually actuated by a valve actuator (electric control motor) through mechanical linkages. Control of the valve actuator is by an output signal from the furnace zone temperature controller. The controller sends an output signal to the valve actuator that proportionally positions the air flow control valve. Thus a 10% output signal will position the valve in the 10% open position and the 70% output signal positions the valve in a 70% open position, etc.

Since the result of a temperature control output is a specific valve position, these systems do not respond directly to system pressure changes. In the typical event of a burner being shut-off in a multiple burner zone, there is a decrease in airflow through the control valve and, as a result, there is a decreased pressure drop across the control valve. With the lower pressure drop, the net pressure downstream of the control valve will increase, thus increasing the flow to the remaining burners. Therefore, as more burners are shut-off, increasing amounts of air (and gas) will go to the remaining burners, partially defeating the purpose (less heat input) of shutting off the burners.

The mass flow control system measures the air mass flow and fuel mass flow and controls each according to a calculated ratio. Differential pressure transmitters or other accurate flow measuring devices are needed to achieve optimum ratio control. Air and fuel temperature and pressure measurements are made to correct for minor variations. A microprocessor based control unit calculates and controls the actual mass flow of both streams to suit the process requirements. North American Combustion Company's MARC® IIIE Combustion Controller is an example of this type of system. These systems are generally complex and thus expensive and are not suitably designed for a simple air valve repositioning.

SUMMARY

This invention concerns a novel method of air control where there is more that one burner or item per control zone on a firnace, heating system, cooling system or other apparatus requiring a controlled air flow to multiple devices. A pressure transducer in the air piping, located downstream of the flow control device, sends a feedback signal to a pressure control loop that is a logical cascade from the temperature control loop. The pressure control loop repositions the air flow control device to compensate for changes in both downstream and upstream conditions.

OBJECTS AND ADVANTAGES

Accordingly, several objects and advantages of our invention are:

1. The system is designed to readjust the air flow control device to correct for variations of the upstream and downstream air pressure.
2. The system is ideally suited to compensate for the pressure drop changes that occur across the zone air flow control valve when burners are started or stopped in a multiple burner zone. This provides a much higher "turn-down ratio" and better control at "low fire" settings.
3. The system can be easily retrofitted to most existing burner system at reasonable cost.
4. The pressure feedback signal system can optimise air flow control valve positioning on; pressure balance, linked valve and flow balance combustion systems.
5. Our invention provides greater fuel efficiency in multiple burner systems by providing better control at low fire and an increased operating range.
6. The system provides a fast response time.

Further objects and advantages of our invention will become apparent from a consideration of the drawings and ensuing description.

DRAWINGS FIGURES

LIST OF REFERENCE NUMERALS

1. Pressure Transducer
2. Pressure Controller
3. Valve Actuator
4. Air Flow Control Valve
5. Fuel Flow Control Valve
6. Temperature Transducer
7. Temperature Controller
8. Motor Speed Drive
9. Combustion Air Blower
10. Burner
11. Furnace
12. Dual Loop Controller
13. Orifice Plate
14. Differential Pressure Regulator
15. Air Manifold

DESCRIPTION OF INVENTION

Physical Description

Figure 1:
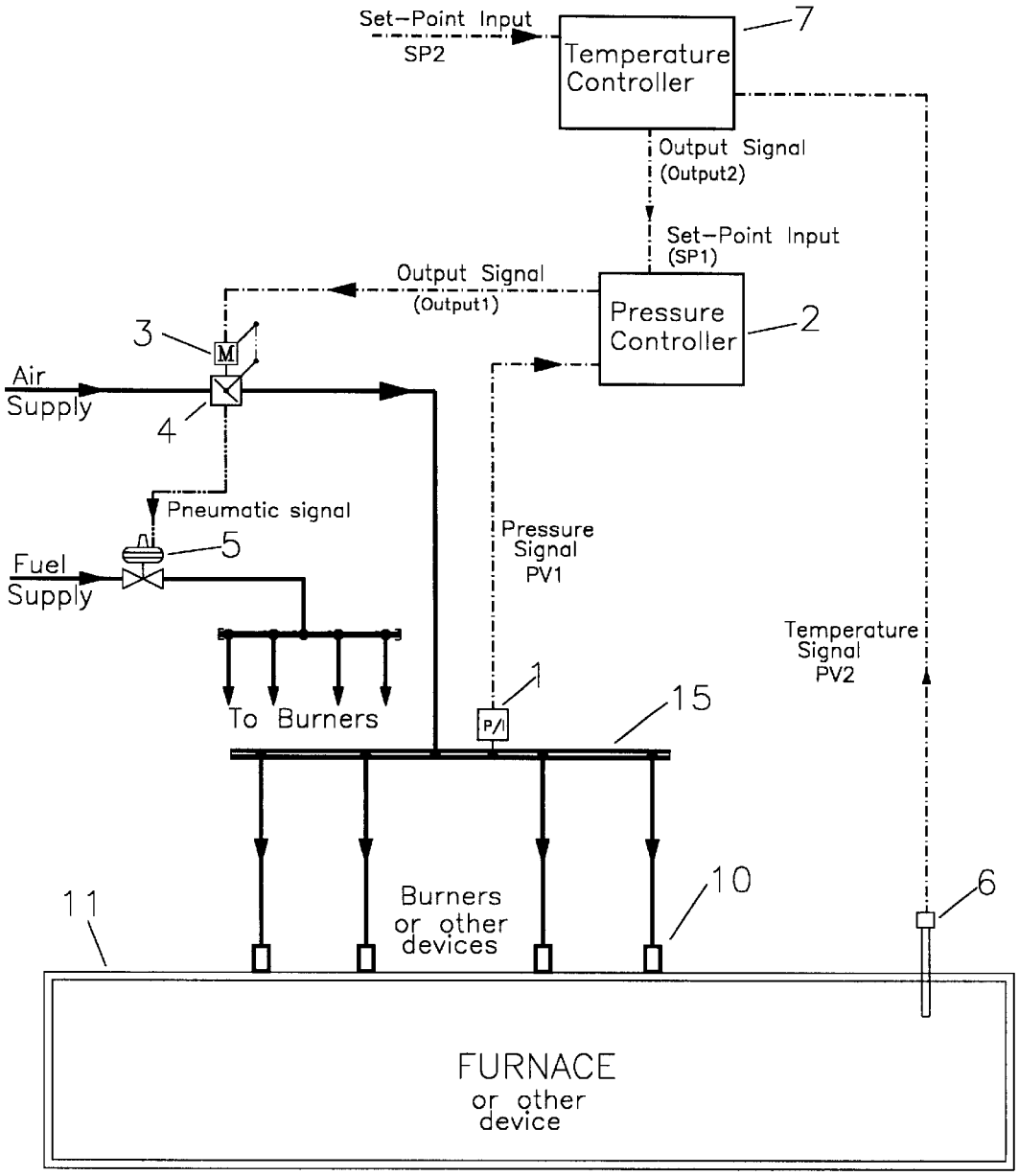
FIG. 1 is a Process and Instrumentation Diagram of the Invention as shown in a pressure balance combustion system with the feedback signal to a valve actuator driving an air flow control butterfly valve.

A pressure transducer (Item 1, FIG. 1) measures the pressure in an air manifold (Item 15, FIG. 1), at a point that is both; upstream of multiple burners (or other devices), and downstream of an air flow control device such as an air flow control valve (Item 4, FIG. 1). The pressure transducer is generally a differential pressure transmitter (with one side open to atmospheric pressure) of about 0–1.5 PSIG (pounds per square inch gage) pressure range with a proportional output signal (generally 4–20 mA (milliamps) or 0–10 volts). A pressure controller (Item 2, FIG. 1) can be any microprocessor based electronic instrument capable of; receiving a remote set-point input (generally 4–20 mA), calculating a PID (proportional, integral and derivative) control loop, and sending a proportional output signal (generally 4–20 mA). The air flow control valve can be a butterfly, ball, adjustable port, gate, globe or other type that is suitably sized for the air flow range and that can be driven by a valve actuator (Item 3, FIG. 1). The valve actuator must be able to accurately position the air flow control valve proportionally to the output signal of the pressure controller.

Figure 2:
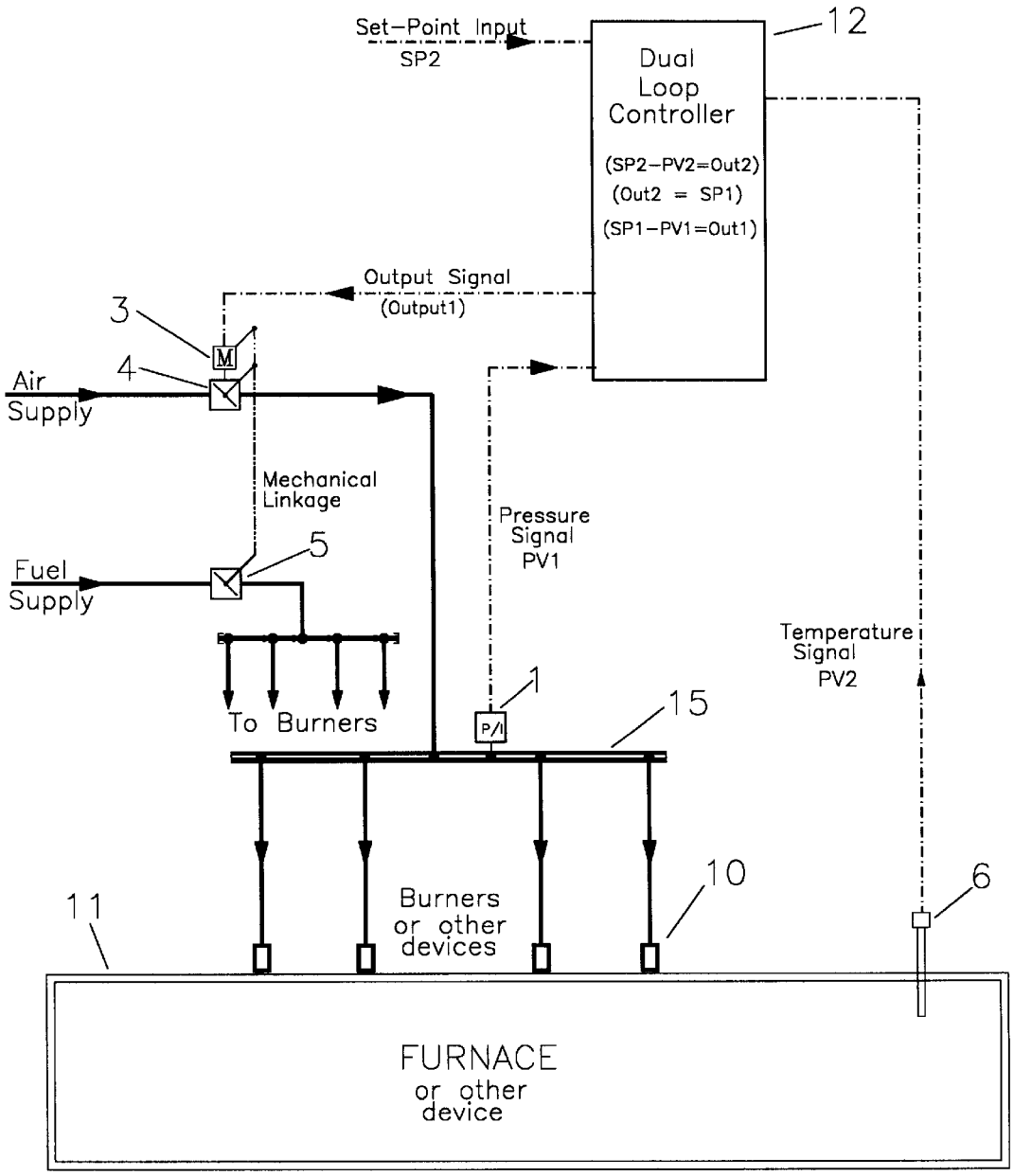
FIG. 2 is a Process and Instrumentation Diagram of the Invention as shown in a linked valve combustion system with the feedback signal to a valve actuator driving linked butterfly air and gas valves. The temperature and pressure control functions are combined in a dual loop controller.
Figure 3:
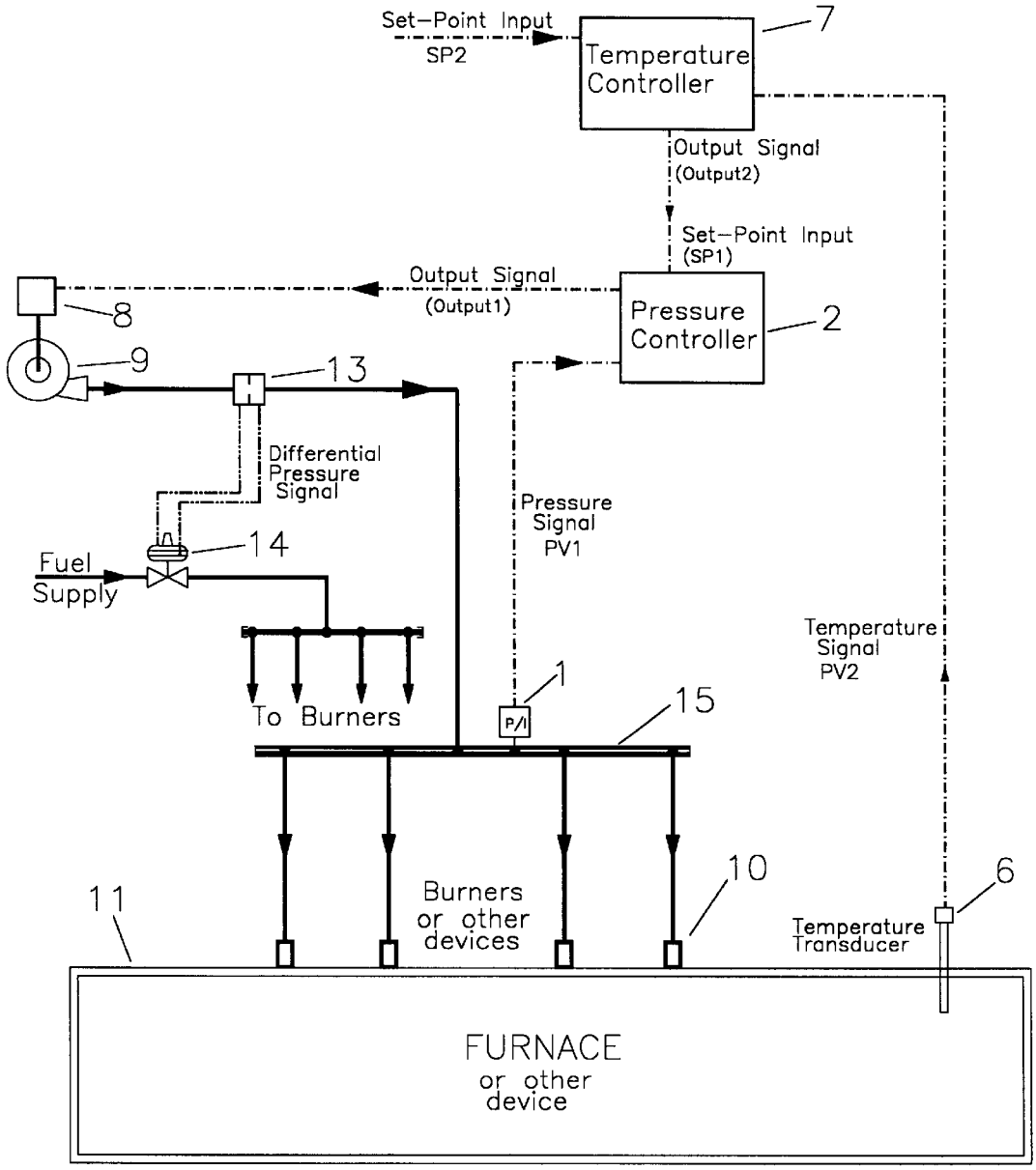
FIG. 3 is a Process and Instrumentation Diagram of the Invention as shown in a flow balance combustion system with the feedback signal to a motor speed drive controlling a combustion air blower.

Fuel flow is varied in proportion to air flow by a fuel flow control valve (Item 5, FIG. 1) that can be of types actuated by either pneumatic signal, mechanical linkage, or differential pressure signal as shown in FIG. 1, FIG. 2 and FIG. 3 respectively. The flow balance combustion system uses an orifice plate (Item 13, FIG. 3) in the zone air line to produce the differential pressure signal that actuates the differential pressure regulator (Item 14, FIG. 3) governing fuel flow. The air and fuel flows both supply a plurality of burners (Item 10, FIG. 1) located in a furnace (Item 11, FIG. 1). A temperature transducer (Item 6, FIG. 1), that can be any appropriate temperature measuring element such as a thermocouple, produces an output signal that is transmitted to a temperature controller (Item 7, FIG. 1). The temperature can be any microprocessor based electronic instrument capable of; receiving a temperature signal, calculating a PID (proportional, integral and derivative) control loop, and sending a proportional output signal (generally 4–20 mA).

Process Description

This invention uses the pressure transducer to sense the air pressure at a location downstream of an air flow control device such as the air flow control valve. The pressure transducer sends an electric signal (called PV1), that is proportional to the air pressure, to the pressure controller. The pressure controller compares this signal to a set-point input signal (called SP1) and computes an output value that is proportional to the difference. This output value is transmitted as an output signal (called Output1) to the valve actuator that operates the air flow control valve. Alternately, said Output1 signal can be transmitted to a motor speed drive (Item 8, FIG. 3) that controls the rotational speed of a combustion air blower (Item 9, FIG. 3) and thus vary the air flow rate.

This pressure control loop is a cascaded from the main temperature control loop. In the temperature control loop, the temperature transducer sends a temperature signal (called PV2), that is proportional to the process temperature of the furnace, to the temperature controller. The temperature controller compares said temperature signal to an internal programmed set-point value (called SP2) and computes an output value (called Output2) that is proportional to the difference. Said Output2 value is transmitted to the pressure controller where it is interpreted as a set-point input (SP1).

The function of the pressure controller and the temperature controller can be combined into a signal unit such as a dual loop controller (Item 12, FIG. 2) or a programmable logic controller (PLC).

The pressure control loop maintains a desired pressure in the air manifold. Any pressure upsets, such as when burners are first started or stopped, are quickly corrected by the opening or closing of the air flow control valve. The desired (set-point) pressure is a function of the demand for heat of the temperature controller. A high manifold pressure results in a high air flow rate and thus high gas flow rate to the burners.

CONCLUSION, RAMIFICATION AND SCOPE OF INVENTION

Thus the reader will see that the Pressure Feedback Signal to Optimise Combustion Air Control invention represents a significant improvement in the state of the art of combustion air control for multiple burner furnaces. The invention's pressure feedback signal is used to reposition the zone air flow control device so that a desired pressure is maintained in the zone's air manifold. This counters unwanted pressure changes that normally would have occurred due to changes in air flow through the control valve.

While the above description contains many specificities, these should not be construed as limitations on the scope of the invention, but rather as an exemplification of one preferred embodiment thereof. Many other variations are possible. For example; The principal could be used for air curtains, cooling jets, air knives, Coanda air jets, paper support high speed jets, ribbon burners (with sections that are closed off to decrease heat input), water agitation, fish tank aeration, water removal air jets, vacuum systems, chip scale removal, and furnace pressure control.

Accordingly, the scope of the invention should be determined not by the embodiments illustrated, but by the appended claims and their legal equivalents.

What we claim is:

1. A combustion control system for two or more burners with a common air supply, comprising;

a) a means for controlling air flow;

b) a means for controlling fuel flow substantially in proportion to said air flow;

c) a pressure transducer for sensing air pressure downstream of said means for controlling air flow and producing a pressure signal indicative thereof;

d) an electronic pressure controller for controlling said means for controlling air flow in response to inputs from the pressure signal and a pressure set-point value;

e) a temperature transducer for sensing process temperature and producing a temperature signal indicative thereof;

f) an electronic temperature controller for generating a temperature controller output signal in response to input from the temperature signal and a temperature set-point value;

g) a means for connecting the temperature controller with the pressure controller such that the temperature controller output signal is used as the pressure set-point value;

whereby the air pressure is controlled in proportion to said temperature controller output signal such that when any number of the burners is shut off, said air flow is automatically adjusted so that air flow to the burners remaining on is kept substantially constant.

2. A combustion control system according to claim 1 wherein said pressure controller and said temperature controller are functionally combined in a control device capable of a plurality of control functions.

3. A combustion control system according to claim 1 wherein said means for controlling air flow is a motor speed control device controlling the rotational speed of an electric motor powering a means for compressing air.

4. A furnace assembly including a plurality of combustion control zones each including the combustion control system according to claim 1.

* * * * *